US011028470B2

(12) United States Patent
Rohatgi et al.

(10) Patent No.: US 11,028,470 B2
(45) Date of Patent: Jun. 8, 2021

(54) METHOD FOR HEAT-TREATING METAL MATERIALS

(71) Applicant: BATTELLE MEMORIAL INSTITUTE, Richland, WA (US)

(72) Inventors: Aashish Rohatgi, Richland, WA (US); Saumyadeep Jana, Kennewick, WA (US)

(73) Assignee: BATTELLE MEMORIAL INSTITUTE, Richland, WA (US)

( * ) Notice: Subject to any disclaimer, the term of this patent is extended or adjusted under 35 U.S.C. 154(b) by 233 days.

(21) Appl. No.: 15/796,357

(22) Filed: Oct. 27, 2017

(65) Prior Publication Data

US 2018/0216216 A1 Aug. 2, 2018

Related U.S. Application Data

(60) Provisional application No. 62/451,380, filed on Jan. 27, 2017.

(51) Int. Cl.
*C22F 1/06* (2006.01)
*C22F 1/043* (2006.01)
(Continued)

(52) U.S. Cl.
CPC ..... *C22F 1/06* (2013.01); *C22F 1/002* (2013.01); *C22F 1/02* (2013.01); *C22F 1/043* (2013.01)

(58) Field of Classification Search
CPC ..... C21D 1/40
See application file for complete search history.

(56) References Cited

U.S. PATENT DOCUMENTS 6,897,407 B2 * 5/2005 Gomez ..... C21D 1/40 219/156
7,714,253 B2 * 5/2010 Machrowicz ..... H05B 3/0014 219/162

(Continued)

FOREIGN PATENT DOCUMENTS

CN 1613566 A 5/2005
CN 101463447 A 6/2009

(Continued)

OTHER PUBLICATIONS

Roger Wright, Steel Decarburization—Mechanisms, Models, Prevention, Correction, and Effects on Component Life, ASM Handbook vol. 4B, Steel Heat Treating Technologies, (Year: 2014).*

(Continued)

*Primary Examiner* — Anthony J Zimmer
*Assistant Examiner* — Michael J Kachmarik
(74) *Attorney, Agent, or Firm* — Derek H. Maughan

(57) ABSTRACT

A method for heat treating metal materials by passing electrical current through a metallic workpiece to heat the workpiece via Joule heating to a preselected temperature for a preselected period of time, based upon the formula $I^2 \times R \times t$, wherein I is current, R is resistance and t is time. The current may be a direct or an alternating one. Various configurations of the method are envisioned wherein multiple current inputs and outputs are attached to the metal material so as to selectively heat specific portions of the piece including irregular shapes and differing diameters.

10 Claims, 4 Drawing Sheets

(51) Int. Cl.
*C22F 1/02* (2006.01)
*C22F 1/00* (2006.01)

(56) References Cited

U.S. PATENT DOCUMENTS

| | | | | |
|---|---|---|---|---|
| 9,783,865 | B2 * | 10/2017 | Sachdev | C21D 8/0263 |
| 2008/0188011 | A1 * | 8/2008 | Henley | B28D 1/221 438/5 |
| 2008/0302775 | A1 * | 12/2008 | Machrowicz | B21D 9/076 219/149 |
| 2009/0183804 | A1 * | 7/2009 | Zhao | C21D 1/18 148/567 |
| 2015/0174983 | A1 * | 6/2015 | Kuroda | B60G 21/055 148/503 |
| 2015/0211085 | A1 * | 7/2015 | Harris | B60N 2/68 297/452.18 |
| 2018/0015522 | A1 * | 1/2018 | Niaraki | B21D 26/06 |

FOREIGN PATENT DOCUMENTS

| | | | |
|---|---|---|---|
| CN | 102417961 | A | 4/2012 |
| CN | 102127622 | B | 12/2012 |
| CN | 103014299 | B | 12/2014 |
| CN | 103614673 | B | 8/2016 |

OTHER PUBLICATIONS

A, Rahnama, Electropulsed Steels, Materials Science and Technology, (Year: 2014).*

Totten, History and Applications, ASM Handbook, vol. 4C, Induction Heating and Heat Treatment, (Year: 2014).*

Richard Haimbaugh, Induction Heat Treating Systems, ASM Handbook vol. 4B Steel Heat Treating Technologies, (Year: 2014).*

Jim Oakes, Furnace Atmosphere Controls in Heat Treating, ASM Handbook vol. 4B Steel Heat Treating Technologies, (Year: 2014).*

Ralph Poor, Furnace Atmospheres for Heat Treating, ASM Handbook, vol. 4B, Steel Heat Treating Technologies, copyright 2014 (Year: 2014).*

Zheng, Y. S., et al. "Effect of electropulse on solid solution treatment of 6061 aluminum alloy." Journal of alloys and compounds 615 (2014): 849-853. (Year: 2014).*

Conrad, H., et al., Influence of the nature of an electric field applied during the solution heat treatment of the Al—Mg—Si—Cu Alloy AA6111 on subsequent natural aging, International Journal of Materials Research, 102, 2011, 1331-1335.

Jiang, Y., et al., On the thermodynamics and kinetics of electropulsing induced dissolution of β-Mg17Al12 phase in an aged Mg—9Al—1Zn alloy, Acta Materials, 57, 2990, 4797-4808.

* cited by examiner

METHOD FOR HEAT-TREATING METAL MATERIALS

CLAIM TO PRIORITY

This application claims priority from of U.S. Patent Application No. 62/451,380 filed by the same inventors on Jan. 27, 2017.

STATEMENT AS TO RIGHTS TO INVENTIONS MADE UNDER FEDERALLY-SPONSORED RESEARCH AND DEVELOPMENT

This invention was made with Government support under Contract DE-AC0576RL01830 awarded by the U.S. Department of Energy. The Government has certain rights in the invention.

BACKGROUND OF THE INVENTION

Field of the Invention

The invention generally relates to materials and materials processing and more particularly to systems and methodologies for heat treating materials such as metals.

Background Information

Metals and metallic alloys are often heat-treated to obtain desired functional performance (strength, toughness, fatigue life, corrosion resistance, etc.) that are otherwise not achievable. Steels are one of the most common materials that are heat-treated to obtain a wide range of mechanical properties such as strength and ductility. Likewise, other metallic materials are also routinely heat-treated, such as aluminum (Al) alloys, magnesium (Mg) alloys, nickel (Ni) alloys, etc. Heat-treatments involve heating/cooling materials for a given temperature-time-heating rate-cooling rate combinations. Such treatments have generally been determined for specific alloys and are published in various handbooks.

Typically, when materials need to be heat-treated, they are heated in a traditional oven/furnace where the oven/furnace is electrically heated through heating elements while the material to be heat-treated is located inside the oven/furnace. The material being heat-treated gets heated by conduction and convection through the surrounding gases and by radiation from the heating elements and the furnace/oven walls. The ovens/furnaces may also be gas/oil fired where the source of heat is gas/oil. Other possible ways of heating materials include induction heating, microwave heating, heating by soaking the material in a hot liquid (e.g. salt bath), infra-red heating, laser heating, etc. Irrespective of the heating method, the heating portion of typical heat-treatments for metals can be very long, sometimes 24 hours or more. For Mg and Al alloys, heat-treating temperatures can be as high as 400-500 C or more. For iron (Fe) and Ni alloys, the heat-treating temperatures can be even higher than those used for Mg and Al. Thus, such heat-treatments can be expensive and energy intensive.

Although heat-treatments are designed to improve/achieve specific properties, long heat-treatments can adversely affect the microstructure as well, e.g. by causing unwanted grain-growth that can lower the beneficial effects of microstructural changes produced by heat-treatment. In some cases, e.g. materials produced as castings by high-pressure die casting (HPDC) technique, some high-temperature heat-treatments are not performed in commercial practice because high temperatures can cause surface "blisters" on the castings due to thermal expansion of gases that were entrapped within the cast material, or even cause plastic deformation and weakening of the structure of the piece.

Therefore, HPDC castings are typically not peak aged (T6 heat-treatment, in industrial terminology) since the high temperatures required for solutionizing (i.e. dissolving solute atoms in the solvent matrix) can cause blisters. Hence, HPDC castings are often given a "T5" heat-treatment that avoids high-temperature solutionizing treatment. But the T5 treatment is unable to increase the strength of the material to the same extent as the T6 treatment. For example, Mg AZ92A alloy yield strength and ultimate tensile strength in T5 condition are 110 MPa and 180 MPa, respectively, which are lower than this alloy's yield strength and ultimate tensile strength in T6 condition of 145 MPa and 275 MPa, respectively. In certain cases, e.g. in castings, sections with different thicknesses have different initial microstructures that respond differently to the given heat-treatment. Hence, it is sometimes not possible to get the best properties across the entire casting by a single heat-treatment and the casting has to be over-engineered to compensate for less-than-optimum properties.

Sometimes, castings are not heat-treated because cooling from a high temperature can produce residual stresses that can cause distortion in the casting. Thus, there's a need to develop more energy efficient methods (e.g. lower temperature and/or shorter time) to heat-treat metallic alloys to reduce energy consumption and costs. Lower solutionizing temperatures and/or shorter time are also needed to avoid the blister formation in HPDC and allow them to be strengthened beyond that achievable by T5 heat-treatment. A more efficient heat-treatment is also needed that can compensate for the variability in the initial microstructure and produce the desired properties in different sections without having to over-engineer it. Finally, a heat-treatment that can be performed at lower temperature can reduce the potential for residual stresses and subsequent distortion. The present descriptions provide advances toward addressing these issues and concerns.

SUMMARY

The present disclosure provides a description of a method for heat treating metal materials by passing electrical current through a metallic workpiece to heat the workpiece via Joule heating to a preselected temperature for a preselected period of time, based upon the formula $I^2 \times R \times t$, wherein I is current, R is resistance and t is time. The current may be a direct or an alternating one. In one application the electrical current is pulsed through the material according to a duty cycle ranging from 1-100%, and the pulse ON time is at least one 1 ms. Various configurations of the method are envisioned wherein multiple current inputs and outputs are attached to the metal material so as to selectively heat specific portions of the piece. In addition various arrangements are envisioned wherein the current is cycled at differing magnitudes or where the joule heating occurs only at a single temperature over the entire piece. In some arrangements the Joule heating may take place with our without additional heating using a conventional means, and can be done in any of a variety of timing sequences. The present invention is particularly useful in heat irregularly shaped pieces which may for example have portions of different shapes, sizes, cross-sectional areas and/or lengths. In some arrangements the electrical heating is done in a specialty gas atmosphere such as an inert gas, an oxidizing atmosphere, or another material that is intended to affect a particular result upon the metal work piece. Examples of such specialty gas atmosphere could include atmospheres containing a gas such as methane, ammonia, nitrogen, oxygen, hydrogen, cyanide and others whether alone or in mixtures. In some instances the method further includes additional heating by a conventional means such as an oven or quenching the metal material after joule heating. In one particular application the sample is quenched in place while still connected to the electrical supply then re-heated immediately by electrical current to a preselected aging temperature. In other applications the sample can be retained in place after quenching for other subsequent heat treatments such as precipitation aging, tempering, annealing, etc.).

The present invention can heat-treat objects that can be of complex shapes, such as items with a circular geometries or a non-uniform diameter and can allow different sections to be subjected to different temperatures and temperature-time histories. In addition the present embodiment does not require application of an external magnetic field on the object being heat-treated, it does not require deformation to occur during the passage of current, and it relies on passing current through the sample to heat it rather than holding it in an externally applied electrical field inside a regular furnace.

Additional advantages and novel features of the present invention will be set forth as follows and will be readily apparent from the descriptions and demonstrations set forth herein. Accordingly, the following descriptions of the present invention should be seen as illustrative of the invention and not as limiting in any way.

DETAILED DESCRIPTION

Figure 1:
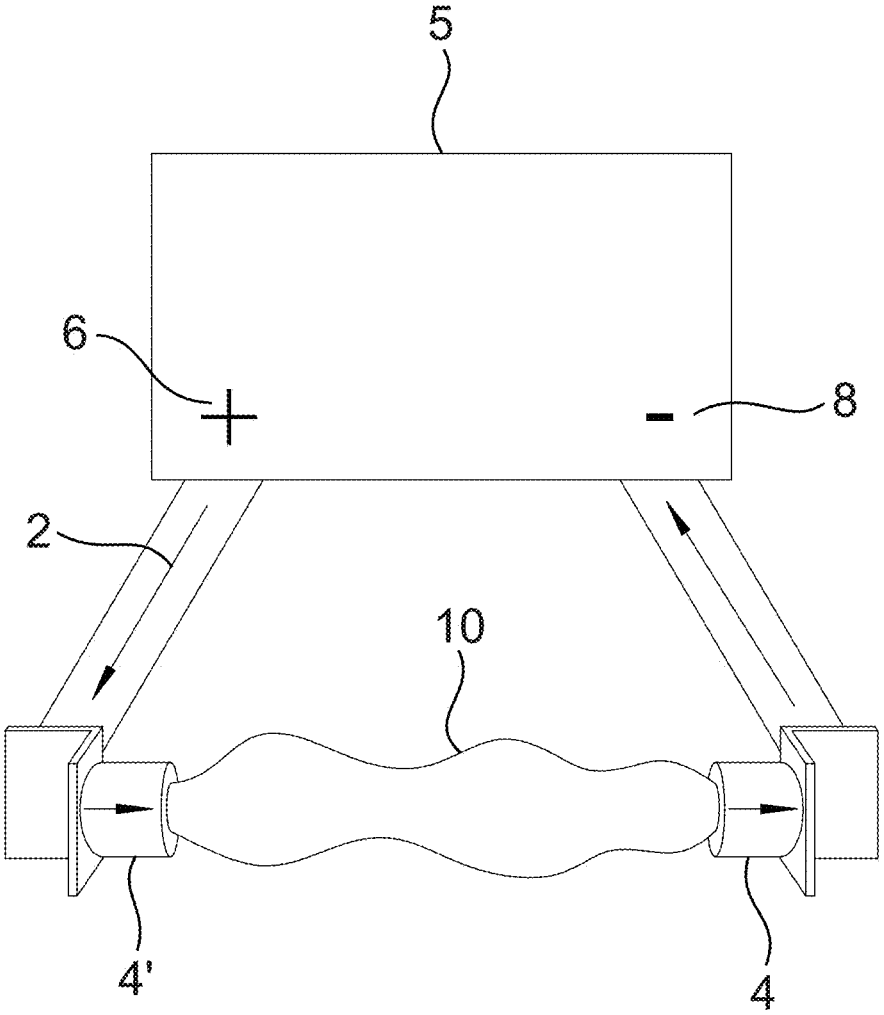
FIG. 1 shows a schematic of the electrical heating setup in one example

The following description includes various modes and examples of the present disclosure. It will be clear from this description of the disclosure that the disclosure is not limited to these illustrated embodiments but that the disclosure also includes a variety of modifications and embodiments thereto. Therefore the present description should be seen as illustrative and not limiting. While the disclosure is susceptible of various modifications and alternative constructions, it should be understood, that there is no intention to limit the disclosure to the specific form disclosed, but, on the contrary, the disclosure is to cover all modifications, alternative constructions, and equivalents falling within the spirit and scope of the disclosure as defined in the claims.

The present disclosure provides examples of heat treating a metal by passing electrical current through metallic materials (such as Al, Mg, etc.) to heat them for the desired temperature-time profile provides various desired attributes while limiting non-desired consequences. Passing a current "I" through a metal material of electrical resistance "R" heats the material by electrical Joule heating which is calculated as $I^2 \times R \times t$. To pass the current, one location of the sample is connected to the one terminal of the electrical power supply while another location on the sample is connected to the other terminal of the power supply. This example is different from induction heating where the current is induced in the material without the material being physically connected to a power supply.

The output current from the power supply can be DC (direct current) or AC (alternating current) and is passed through the piece and is heated by the principles of Joule heating. In a DC arrangement the polarity of the terminals does not change during operation i.e. the positive terminal stays positive while the negative terminal stays negative. On the other hand, in an AC arrangement, the polarity of the terminals alternates between positive and negative. In addition, the current can be pulsed i.e. it is turned on for a given duration of time, and then turned off for a given duration of time. Such on-off cycles can continue for as long as needed. During pulsing a DC current, the polarity of the terminals can stay fixed for all the pulses, or the polarity can be reversed in some pulses.

This methodology differs from others primarily because multiple current inlets/outlets can be switched back and forth to control temperature on a non-uniform geometry object for the purpose of generating a desired thermal distribution in the object. Thus, in one instance during heat-treatment, the current may be flowing through one current path within the workpiece resulting in a particular amount of Joule heating and heat distribution, while in the next instance, the current may be flowing through a different path within the workpiece resulting in a different amount of Joule heating and heat distribution compared to the first instance. In one set of embodiments electrical current pulse widths are significantly longer (>=1000 microseconds) than other practices and applications. In another set of embodiments, the current is not pulsed. In another set of embodiments, the current can be DC or AC.

Figure 2A:
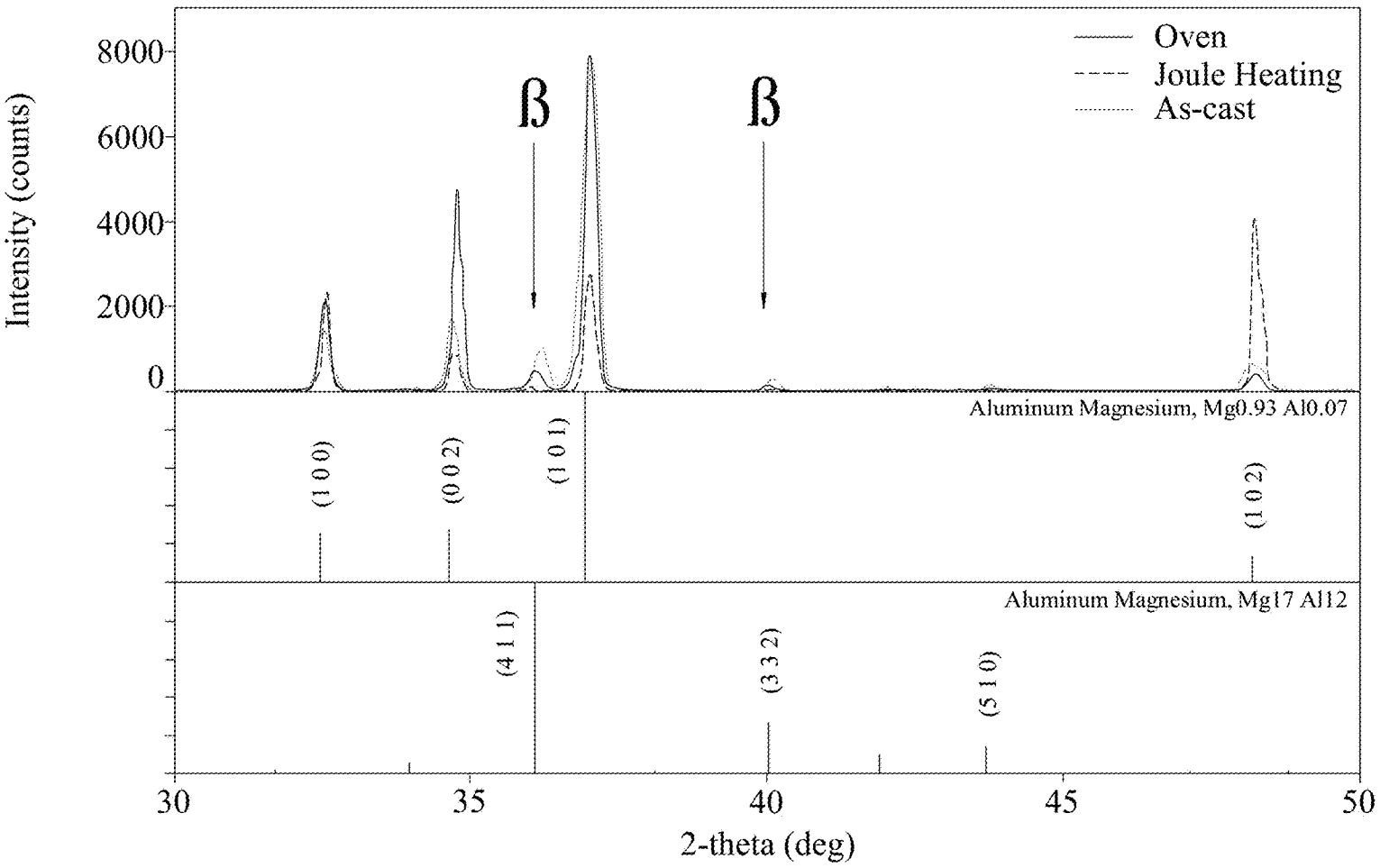
FIGS. 2(*a*) and 2(*b*) show the X-ray diffraction spectra of AZ91E samples
Figure 2B:
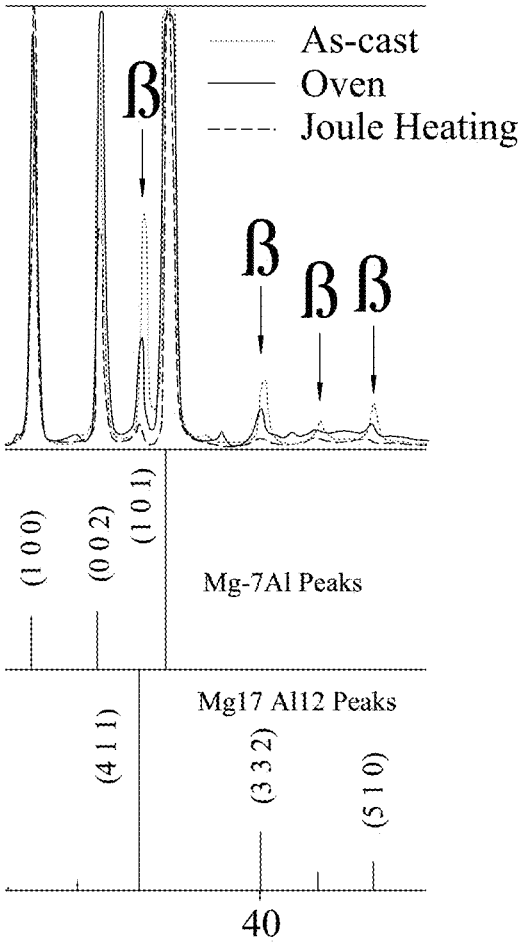
Figure 3:
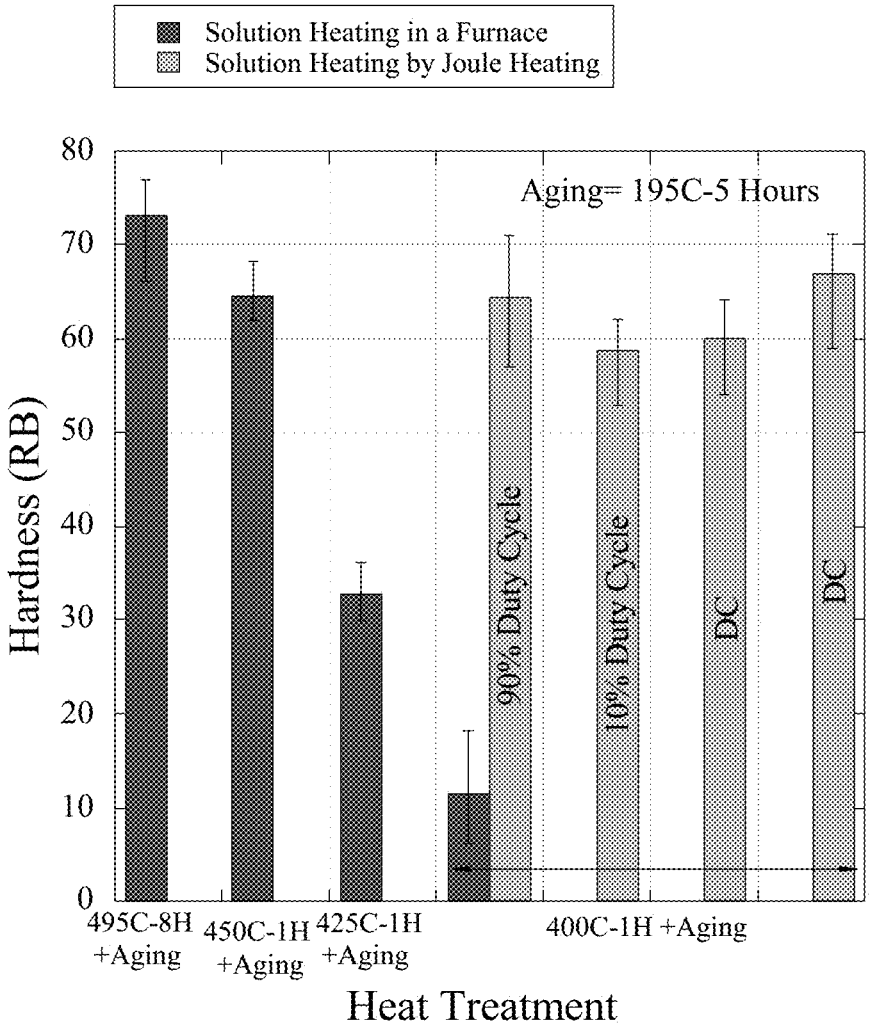
FIG. 3 shows the hardness of Al 319 alloy as a function of different solution heat-treatments that were all followed by water quenching and aging.

FIGS. 1-3 show various embodiments and examples of the present invention. Beginning first with FIG. 1, FIG. 1 shows an exemplary schematic of the electrical heating setup. The arrows show the current path, (2) through the cables and the electrodes (4, 4'), with a test sample 10 held between the electrodes (4, 4'). In one application, passing electrical current through metallic materials (such as Al, Mg, etc.) to heat them for the desired temperature-time profile provides various desired attributes while limiting non-desired consequences such as plastic deformation. Thus, in a simple example, one location of the sample (10) is operatively connected to the positive terminal (6) of the power supply while another location on the sample is connected to the negative terminal (8) of the power supply. This is distinct from induction heating where the current is induced in the material without the material being physically connected to a power supply (5).

This invention differs from others in a variety of ways including enabling the operation of targeted heat processing by using multiple current inlets/outlets that can be switched back and forth to control temperature on a non-uniform geometry object for the purpose of generating a desired thermal distribution in the object. Thus, in one instance during heat-treatment, the current may be flowing through one current path within the workpiece resulting in a particular amount of Joule heating and heat distribution, while in the next instance, the current may be flowing through a different path within the workpiece resulting in a different amount of Joule heating and heat distribution compared to the first instance.

In one set of experiments, pulsed electrical currents were used to heat the material and accelerate microstructural changes and/or produce better mechanical properties and/or lower the temperature needed to achieve microstructural changes than temperature that are required in conventional heating processes. In one set of experiments a ~25.4 mm long×10 mm diameter cylindrical sample was machined out of a commercial AZ91E casting by electro-discharge machining (EDM). A pulsed DC (direct current) was passed through the sample to heat it via Joule heating with the goal of dissolving the β-$Mg_{17}Al_{12}$ precipitates that were present in the as-received casting. Starting from a sample at a nominal room-temperature of 25 C, the sample was heated gradually so as to reach the desired temperature in a few minutes. The pulse parameters were such that the current was ON for 1 milliseconds and OFF for 2 milliseconds. This pulse cycle implies a duty cycle (i.e. ON time in a cycle divided by ON+OFF time in a cycle) of 33.3%. The peak current amplitude was in the range of 200-500 Amperes and was controlled to maintain a temperature of approximately 335-345 degrees C. in the center of the specimen for 10 minutes. At the end of 10 minutes, the sample was quenched in water at room-temperature. A duty cycle of 33.3% implies that even though the sample was held at a temperature of 335-345 C for 10 minutes, the current was actually flowing through it for only 33.3% of the test duration (10 minutes), i.e. 200 seconds i.e. 3 minutes and 20 seconds.

Initial results with Mg and Al cast samples have shown that passing the electrical current through the Mg or Al cast sample to be more effective than the traditional method of heating the same material in an oven/furnace. In case of Mg AZ91 alloy, this invention was ~3-times more effective in producing the desired microstructural change (i.e. dissolving Mg17Al12 precipitates) than oven/furnace heating to the same temperature-time was. In case of Al 319 alloy, this invention was able to produce significantly higher hardness than by traditional method of heating the sample in an oven/furnace.

Often, objects to be heat-treated are irregular or complex in shape with differing cross-sections and section lengths. The current flowing through a material is inversely proportion to its electrical resistance for a given applied voltage. Further, the electrical resistance is directly proportional to the length and inversely proportional to cross-sectional area. Thus, in an object with different cross-sections, its local electrical resistance will vary depending upon the location. In addition, current may travel through different paths within the object. Thus, sending current through an object with different possible current paths and each path with its own electrical resistance, may lead to non-uniform heating. Therefore, another embodiment of the invention is contemplated wherein the object to be heated can have multiple current inputs and multiple current outputs. Thus, current may be input/output using any combination of electrical connections so as to generate the desired thermal profile in the object. Such control can allow different sections to be heated to different temperatures optimized for that section whereas in conventional furnace/oven, the entire object is typically held at a given fixed temperature.

In an industrial setting, the present methodology could revolutionize the heat-treating process through energy, time and cost savings as well as performing heat-treatments that were not feasible before (e.g. T6 heat-treatment on HPDC castings). Examples of such effects are shown for example in FIGS. 2 and 3.

Referring first to FIG. 2, FIGS. 2(*a*) and 2(*b*) show X-ray diffraction spectra of AZ91E samples in the as-cast condition, after heating in the oven at 335 C for 10 minutes, and after Joule heating to 335-345 C for 10 minutes by passing pulsed DC current. The peaks of interest are indicated by arrows labeled as "β" i.e. the $Mg_{17}Al_{12}$ phase. FIG. 3 shows the hardness of Al 319 alloy as a function of different solution heat-treatments that were all followed by water quenching and aging. This figure shows hardness of samples that were solution heated in a furnace compared to hardness of samples that were electrically solution heated.

A 10 mm diameter sample was EDM machined from the original AZ91E casting and heated in an oven at approximately 335 C for 10 minutes followed by water quenching. For comparison purposes, another 10 mm diameter sample was EDM machined from the original AZ91E casting and Joule heated at approximately 335-345 C for 10 minutes followed by water quenching. The goal in both of these samples was to dissolve β-$Mg_{17}Al_{12}$ precipitates that were initially present in the starting AZ91E alloy casting. The volume fraction of $Mg_{17}Al_{12}$ precipitates was determined by analyzing the β peak heights in the x-ray diffraction spectrum in the starting as-cast AZ91E alloy and after heating AZ91E samples by the two types of heat-treatments (see FIGS. 2*a* and 2*b*). The x-ray diffraction data showed that the volume fraction of $Mg_{17}Al_{12}$ in the starting AZ91E alloy was ~11-13%, after oven heat-treatment followed by water quenching AZ91E alloy the $Mg_{17}Al_{12}$ volume fraction was 6-7% and after pulse-electrical heating followed by water quenching AZ91E the $Mg_{17}Al_{12}$ volume fraction was 0.5-2%. Thus, the pulsed electrical heating was able to dissolve almost 3× greater $Mg_{17}Al_{12}$ than oven heating when the respective samples were solution heated for the same temperature and time.

In another example, we've performed electrical heating of an Al 319 casting alloy and compared it to conventional furnace heating of the same alloy—the respective samples were heated (called, solutionizing treatment) to 400 C for 60 minutes, followed by quenching in water at room-temperature. Starting from a sample at a nominal room-temperature of 25 C, the sample was heated gradually so as to reach the solution temperature in a few minutes. Following quenching, both samples (electrical solution heated sample and the furnace solution heated sample) were heated again (called, aging heat-treatment) in a furnace at 195 C for 5 hours followed by quenching in water at room-temperature. The goal of the solutionizing treatment+quenching+aging was to increase the hardness of the material through the mechanism commonly known in the field of metallurgy as precipitation aging. In the electrically solution heated samples, two types of electrical heating parameters were used: Sample I—the current passing through the sample was pulsed and in each cycle, the current was ON for 9 ms and OFF for 1 ms, resulting in a duty cycle of 90%. The peak current amplitude was in the range of 200-300 Amperes to maintain the sample at a solutionizing temperature of approximately 400 C.

In Sample II, the current was not pulsed and instead, a non-pulsing DC current (i.e. duty cycle of 100%) in the range of 200-300 Amperes was passed through the sample to maintain it at a solutionizing temperature of approximately 400 C. For both samples, an inert gas was flown around the samples. Immediately following electrical solution heating, both samples were quenched in water at room-temperature. They were then aged in a furnace at 195 C for 5 hours followed by water quenching at room-temperature. The average hardness of the starting as-cast Al A319 alloy was measured to be approximately 45 Rockwell B. The average hardness of Sample I, i.e. pulsed-electrical solution heated sample, followed by aging was 64.5 Rockwell B. The average hardness of Sample II, i.e. non-pulsing DC solution heated sample, followed by aging was 67 Rockwell B. The average hardness of the furnace solution heated sample, followed by aging, was 11.6 Rockwell B.

Thus, the electrical solution heating method (followed by aging), under both pulsing and non-pulsing conditions, was able to increase the hardness of the starting alloy whereas conventional furnace heating of the starting alloy lowered the hardness. Further, conventionally, this alloy is typically solutionized in furnace at 495 C for up to 8 hours, followed by aging at 195 C for 5 hours to get a high average hardness of 73 Rockwell B. The 64.5 Rockwell B hardness (Sample I, solution heated by pulsed current) and 67 Rockwell B hardness (Sample II, solution heated by non-pulsing DC current), obtained in the above electrical heating experiments with solution heating at 400 C for 1 hour suggests that it is possible to achieve hardness similar to 73 Rockwell B by electrical heating at temperatures below 495 C and for time shorter than 8 hours. FIG. 3 summarizes and compares the hardness of samples as a function of heating method (furnace vs. electrical) as well as after solution heated to different temperatures followed by water quenching and aging.

These results demonstrate that Joule heating of metal parts can provide particular advantages to hardening and otherwise treating metal materials. It can, for example, allow for the heat treatment of castings without producing residual stresses that can cause distortion in the casting. It can provide an energy efficient method (e.g. lower temperature and/or shorter time) to heat-treat metallic alloys to reduce energy consumption and costs. Lower temperature and/or shorter time enabled by Joule heating can help in avoiding the blister formation in HPDC and allow HPDC castings to be strengthened beyond that achievable by T5 heat-treatment. By controlling current path and the resulting Joule heat distribution, Joule heating can also compensate for the variability in the initial microstructure in different sections of a casting. In other words, Joule heating can produce the desired properties in those different sections by tailoring the local temperature suitable for the local microstructure without having to over-engineer it. Finally, the described methods can be performed at lower temperature can reduce the potential for residual stresses and subsequent distortion.

Additional objects, advantages and novel features of the present invention are described herein and will become further readily apparent to those skilled in this art from the following detailed description. In the preceding and following descriptions we have shown and described only the preferred embodiment of the invention, by way of illustration of the best mode contemplated for carrying out the invention. As will be realized, the invention is capable of modification in various respects without departing from the invention. Accordingly, the drawings and description of the preferred embodiment set forth herein are to be regarded as illustrative in nature, and not as restrictive.

What is claimed is:

1. A method for electrically heat treating an aluminum 319 alloy workpiece comprising the step of: pulsing electrical current directly through the workpiece using at least one current input to heat the workpiece via resistive heating to a temperature less than 450 degrees C. for no more than 1 hour, then aging the piece to produce a hardened material having a harness of at least 50 on the RB scale.

2. The method of claim 1 wherein the current is direct current.

3. The method of claim 1 wherein the current is alternating current.

4. The method of claim 1 wherein the electrical heating is done in a specialty gas atmosphere.

5. The method of claim 4 wherein the specialty gas atmosphere is an inert gas atmosphere.

6. The method of claim 4 wherein the specialty gas atmosphere is an oxidizing atmosphere.

7. The method of claim 4 wherein the specialty gas atmosphere includes a mixture of gases including at least one gas selected from the group consisting of methane, ammonia, nitrogen, oxygen, hydrogen, and cyanide.

8. The method of claim 1 wherein the current cycles at differing magnitudes.

9. The method of claim 1 wherein the metallic work piece is quenched in place while still connected to the electrical supply then re-heated by electrical current to a preselected temperature for subsequent treatment.

10. The method of claim 1 wherein the work piece has a nonuniform three dimensional shape including a circular geometry.

* * * * *